US005452828A

United States Patent [19]

Kolton et al.

[11] Patent Number: 5,452,828

[45] Date of Patent: Sep. 26, 1995

[54] BELT AND PROMOTIONAL ARTICLES ASSEMBLY

[75] Inventors: Chester Kolton, Westfield; Stuart S. Spater, Livingston, both of N.J.

[73] Assignee: B&G Plastics, Inc., Newark, N.J.

[21] Appl. No.: 179,910

[22] Filed: Jan. 11, 1994

[51] Int. Cl.[6] ..... A47G 25/18; B65D 85/40; A45F 5/00

[52] U.S. Cl. ..... 223/88; 223/85; 206/301; 224/253; 224/252

[58] Field of Search ..... 223/85, 87, DIG. 1, 223/88; 224/252, 253; 2/312, 314, 319; 206/301

[56] References Cited

U.S. PATENT DOCUMENTS

| | | | |
|---|---|---|---|
| 1,373,003 | 3/1921 | Hoffman | 224/252 |
| 2,509,428 | 5/1950 | Greene | 224/252 |
| 2,543,313 | 2/1951 | Dietzgen | 224/252 |
| 3,069,009 | 12/1962 | Hoeflich | 223/87 |
| 3,513,575 | 5/1970 | Schiller | 40/2 |
| 4,063,669 | 12/1977 | Smilow et al. | 223/87 |
| 4,746,042 | 5/1988 | King | 224/252 |

*Primary Examiner*—Clifford D. Crowder
*Assistant Examiner*—Bibhu Mohanty
*Attorney, Agent, or Firm*—Robin, Blecker, Daley & Driscoll

[57] ABSTRACT

A display assembly includes a belt having a buckle, a belt blank secured with the buckle and a retaining member secured with the belt blank adjacent the buckle for retaining a portion of the belt blank issuing from the buckle upon belt buckling and a hanger having a hook portion disposed on the belt retaining member, the hook portion defining locking structure for capturing the belt retaining member in the .hook portion, and a compartment portion depending from the hook portion, the compartment being adapted for containment of an article to be marketed with the belt.

6 Claims, 2 Drawing Sheets

BELT AND PROMOTIONAL ARTICLES ASSEMBLY

FIELD OF THE INVENTION

This invention relates generally to promotional merchandizing and pertains more particularly to an assembly of a belt and an article to be marketed therewith.

BACKGROUND OF THE INVENTION

Customary belts include a buckle, a belt blank secured with the buckle and a retaining member, sometimes referred to a belt loop, secured with the belt blank adjacent the buckle for retaining a portion of the belt blank issuing from the buckle upon belt buckling.

While the belt loop has found utilitarian use other than its above function, i.e., for indicating belt name and price, as shown in U.S. Pat. No. 3,513,575, other utilitarian use is not known to have occurred.

SUMMARY OF THE INVENTION

The primary object of the present invention is to facilitate the marketing of belts with other articles, such as a promotional article.

A more particular object of the invention is to secure a promotional article with a belt such that the belt, when hung, as by the use of hangers shown in commonly-assigned U.S. Pat. Nos. 3,710,996 and 4,063,669, will have the promotional article also hung therewith.

In attaining these and other objects, applicants provide, in combination, a belt having a buckle, a belt blank secured with the buckle and a retaining member secured with the belt blank adjacent the buckle for retaining a portion of the belt blank issuing from the buckle upon belt buckling and a hanger having a hook portion disposed on the belt retaining member, the hook portion defining locking structure for capturing the belt retaining member in the hook portion, and a compartment portion depending from the hook portion, the compartment being adapted for containment of an article to be marketed with the belt.

More particularly, the hanger hook portion has first and second mutually facing parts and a third part extending transversely of the first and second mutually facing parts and joining them, the compartment portion being bounded in part by the second mutually facing part.

Preferably, the locking structure is constituted by interfitting structures respectively on the first and second mutually facing parts. Further, the compartment portion desirably comprises an open-ended box member, the open end of the box member being closed by the second mutually facing part.

The foregoing and other objects and features of the invention will be further evident from the following detailed description of preferred embodiments thereof and from the drawings in which like components are identified by like reference numerals throughout.

DESCRIPTION OF PREFERRED EMBODIMENTS AND PRACTICES

Figure 2:
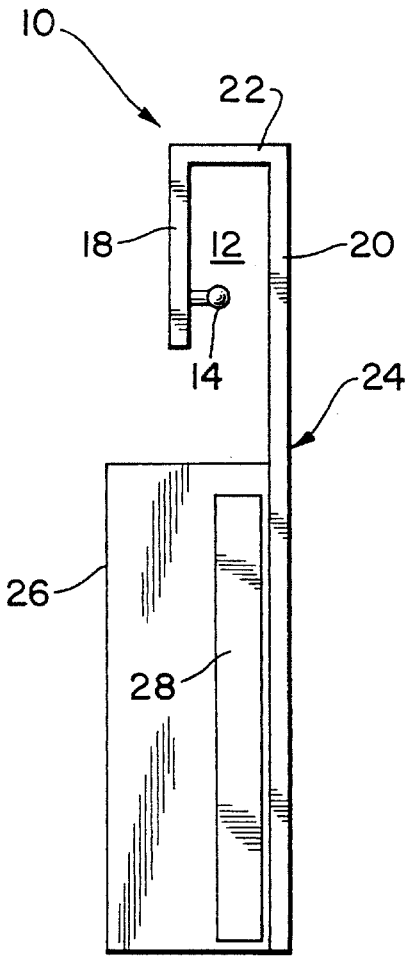
FIG. 2 is a right side elevation of the hanger of FIG. 1.
Figure 1:
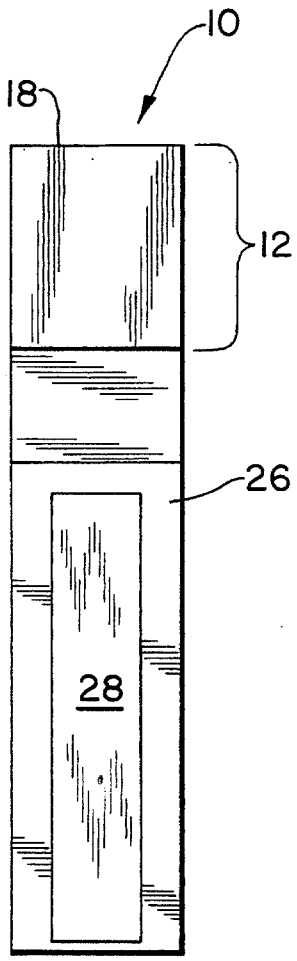
FIG. 1 is a front elevation of a hanger in accordance with the invention.
Figure 3:
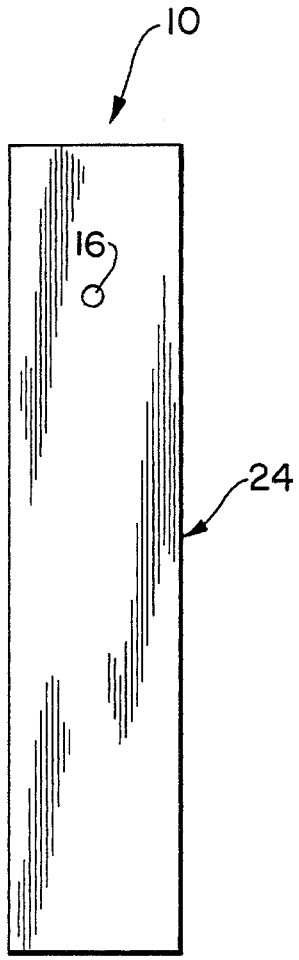
FIG. 3 is rear elevation of the hanger of FIG. 1.

Referring to FIGS. 1–3, hanger 10, comprised of an elongate synthetic plastic body, has a hook portion 12 which defines locking structure inclusive of projection 14 and a latching aperture 16. Hook portion 12 has first and second mutually facing parts 18 and 20 and third part 22 extending transversely of the first and second mutually facing parts and joining them. As indicated, projection 14 is supported by hook portion part 18 and latching aperture 16 is formed in hook portion part 20. The locking structure is described in the above-noted commonly-assigned patents and, where it is desired to have a more secure lock feature, the structure may be as is described in U.S. Pat. No. 5,005,741, also commonly-assigned herewith.

Lower portion 24 of hanger 10 is continuous with hook portion 12, particularly also comprising mutually facing part 20 and supports hollow shell 26, preferably heat sealed thereto, to define a compartment bounded in part by mutually facing part 20. Article 28 is shown in the compartment and may be a wristwatch or the like.

Figure 4:
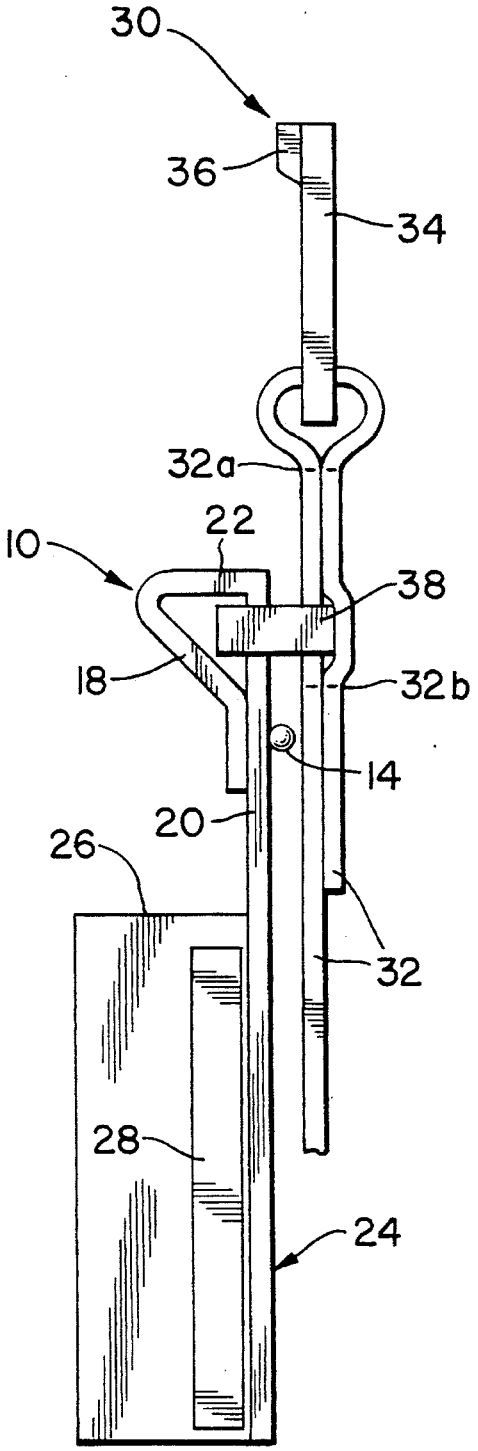
FIG. 4 is a side elevation of an assembly in accordance with the invention.
Figure 5:
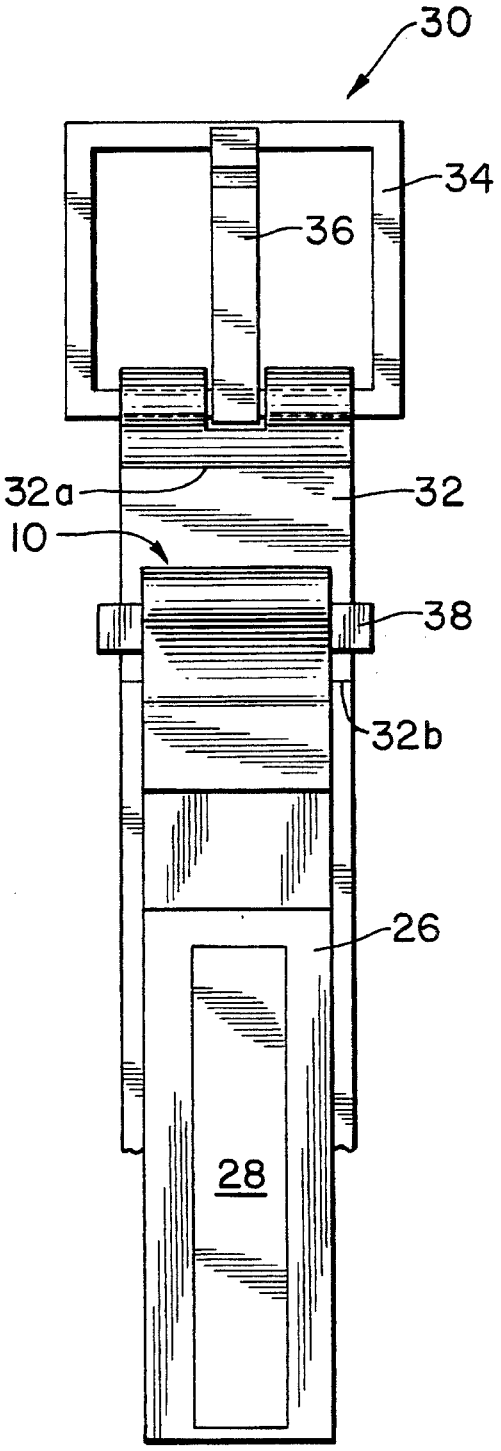
FIG. 5 is a front elevation of the assembly of FIG. 4.

Referring now to FIGS. 4 and 5, hanger 10 is shown assembled with belt 30. Belt 30 includes conventional structure, inclusive of belt blank 32, buckle frame 34, prong 36 and belt loop 38. Stitching lines are indicated at **32*a* and 32*b***.

In reaching the assembly, belt loop is inserted into hook portion 12 of hanger 10 and the latching structure is engaged by forcing projection 14 into latching aperture 16. As is also seen in FIGS. 4, hook portion parts 22 and 20 maintain their orthogonality, only part 18 and the distal end of part 22 being deformed in engaging the latching structure. Accordingly, hanger 10 extends vertically in parallel with belt 30.

By way of summary and introduction to the ensuing claims, the invention will be seen to provide, in a first assembly, a belt having a buckle, a belt blank secured with the buckle and a retaining member secured with the belt blank adjacent the buckle for retaining a portion of the belt blank issuing from the buckle upon belt buckling and a hanger having a hook portion disposed on the belt retaining member, the hook portion defining locking means for capturing the belt retaining member in the hook portion and a compartment portion depending from the hook portion, the compartment portion being adapted for containment of an article to be marketed with the belt. In a second assembly, the invention provides the first assembly with the article in place in the compartment. In this connection, while the above description provides the promotional article and hanger as fully assembled through heat sealing of a shell onto the rearward facing member, with the article in place prior to the heat sealing, the invention contemplates a compartment which is receptive to the article at any point in time and then closable. By way of example, the compartment may have an upper shell lid which is openable to receive the article with the lid and rearward facing member defining locking structure as discussed for the hanger hook portion.

Various changes to the particularly disclosed embodiment and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination:

(a) a belt having a buckle, an elongate belt blank secured with said buckle and in vertical disposition and a retaining member fixedly secured with said belt blank adjacent said buckle and extending horizontally transversely of said belt blank, said retaining member retaining a portion of said belt blank issuing from said buckle upon belt buckling; and (b) a hanger having a hook portion disposed on said belt retaining member, said hook portion having locking structure capturing said belt retaining member in said hook portion and an elongate compartment portion depending from said hook portion and being in vertical disposition in overlying relation to said belt blank, said compartment being adapted for containment of an article to be marketed with said belt.

2. The invention claimed in claim 1 wherein said hanger hook portion has first and second mutually facing parts each in vertical disposition in overlying relation to said belt blank and a third part extending between said first and second mutually facing parts and joining them, said compartment portion being bounded in part by said second mutually facing part.

3. The invention claimed in claim 2 wherein said locking structure is constituted by a latching projection on one of said first and second mutually facing parts and a latching recess on the other of said first and second mutually facing parts.

4. In combination:

(a) a belt having a buckle, an elongate belt blank secured with said buckle and in vertical disposition and a retaining member fixedly secured with said belt blank adjacent said buckle and extending horizontally transversely of said belt blank, said retaining member retaining a portion of said belt blank issuing from said buckle upon belt buckling; and (b) a hanger having a hook portion disposed on said belt retaining member, said hook portion having locking structure capturing said belt retaining member in said hook portion and an elongate compartment portion depending from said hook portion and being in vertical disposition in overlying relation to said belt blank; and (c) an article to be marketed with said belt in said compartment portion.

5. The invention claimed in claim 4 wherein said hanger hook portion has first and second mutually facing parts each in vertical disposition in overlying relation to said belt blank and a third part extending between said first and second mutually facing parts and joining them, said compartment portion being bounded in part by said second mutually facing part.

6. The invention claimed in claim 5 wherein said locking structure is constituted by a latching projection on one of said first and second mutually facing parts and a latching recess on the other of said first and second mutually facing parts.

* * * * *